US012486682B2

(12) United States Patent
Scepaniak et al.

(10) Patent No.: US 12,486,682 B2
(45) Date of Patent: Dec. 2, 2025

(54) ROOF EDGE SAFETY SYSTEM

(71) Applicant: Scepaniak IP Holdings, LLC, Waite Park, MN (US)

(72) Inventors: Kurtis D. Scepaniak, Cold Spring, MN (US); Michael S. Marquette, Melrose, MN (US); Travis M. Marquette, Bowlus, MN (US)

(73) Assignee: Scepaniak IP Holdings, LLC, Waite Park, MN (US)

( * ) Notice: Subject to any disclaimer, the term of this patent is extended or adjusted under 35 U.S.C. 154(b) by 222 days.

(21) Appl. No.: 18/298,367

(22) Filed: Apr. 10, 2023

(65) Prior Publication Data

US 2023/0323686 A1 Oct. 12, 2023

Related U.S. Application Data

(60) Provisional application No. 63/329,290, filed on Apr. 8, 2022.

(51) Int. Cl.
*E04G 21/32* (2006.01)

(52) U.S. Cl.
CPC ..... *E04G 21/3214* (2013.01)

(58) Field of Classification Search
CPC ..... E04G 21/3214; E04G 21/3219; E04G 21/3223; E04G 21/3242; Y10S 256/06
See application file for complete search history.

(56) References Cited

U.S. PATENT DOCUMENTS

| | | | |
|---|---|---|---|
| 350,289 | A | 10/1886 | Brown |
| 354,880 | A | 12/1886 | Amon |
| 404,286 | A | 5/1889 | King et al. |
| 475,054 | A | 5/1892 | Ellrich |
| 670,904 | A | 3/1901 | Pittman |
| 808,602 | A | 12/1905 | Fergusson |
| 901,801 | A | 10/1908 | Frey |
| 1,039,554 | A | 9/1912 | Lindhorst |
| 1,165,435 | A | 12/1915 | Mishel |
| 1,189,098 | A | 6/1916 | Hall |
| 1,239,472 | A | 9/1917 | Florian |
| 1,312,399 | A | 8/1919 | Heywood |

(Continued)

FOREIGN PATENT DOCUMENTS

| | | | |
|---|---|---|---|
| AU | 2012101371 B4 | 10/2012 | |
| CA | 2495683 A1 * | 8/2006 | ..... E04G 21/3214 |

(Continued)

*Primary Examiner* — Christine T Cajilig
(74) *Attorney, Agent, or Firm* — Albert W. Watkins

(57) ABSTRACT

An edge safety system comprises at least one edge safety support and a tensioned cable. The edge safety support comprises an edge clamp having a first contact, and a bifurcated clamp leg supporting a second contact and a third contact opposed to said first contact. A clamp driver is configured to generate a clamping force. A standard has a first terminus and is coupled adjacent to the first terminus to and rises from the edge clamp and extends therefrom to a top elevation, and has at least one rope guide. A tensioned cable passes through the at least one rope guide. An optional elevation pole has a foot that is configured to engage with a roof, a riser rising from the foot, and at least one rope guide affixed to the riser, the tensioned cable passing through the at least one elevation pole rope guide.

9 Claims, 10 Drawing Sheets

(56) References Cited

U.S. PATENT DOCUMENTS

| | | | | |
|---|---|---|---|---|
| 1,550,472 | A | 8/1925 | Typanski | |
| 1,556,835 | A | 10/1925 | Huhn | |
| 2,001,796 | A | 5/1935 | Nickolaus | |
| 2,347,745 | A | 5/1944 | Mckinney | |
| 2,598,130 | A | 5/1952 | Mallison | |
| 2,706,662 | A | 4/1955 | Brown | |
| 2,714,044 | A | 7/1955 | Otani | |
| 2,805,103 | A | 9/1957 | Casimer | |
| 3,084,759 | A | 4/1963 | Squire | |
| 3,424,412 | A | 1/1969 | Gayle | |
| 3,480,242 | A | 11/1969 | Cleveland | |
| 3,480,257 | A | 11/1969 | Bourn | |
| 3,632,089 | A | 1/1972 | Smith | |
| 3,747,898 | A | 7/1973 | Warren | |
| 3,756,568 | A | 9/1973 | Mocny et al. | |
| 3,863,899 | A | 2/1975 | Werner | |
| 3,863,900 | A | 2/1975 | Dagiel et al. | |
| 3,880,405 | A | 4/1975 | Brueske | |
| 3,938,619 | A | 2/1976 | Kurabayashi et al. | |
| 3,980,278 | A | 9/1976 | Elias | |
| 3,995,833 | A | 12/1976 | Mclaughlin et al. | |
| 3,995,834 | A | 12/1976 | Melfi | |
| 4,037,824 | A | 7/1977 | Whitmer | |
| 4,669,577 | A | 6/1987 | Werner | |
| 4,917,249 | A | 4/1990 | King | |
| 5,029,670 | A | 7/1991 | Whitmer | |
| D331,529 | S | 12/1992 | Reinklou | |
| 5,255,799 | A | 10/1993 | Haynes | |
| 5,263,550 | A | 11/1993 | Jines et al. | |
| 5,307,897 | A | 5/1994 | Turner et al. | |
| 5,353,891 | A | 10/1994 | Griek et al. | |
| 5,433,044 | A | 7/1995 | Walcher et al. | |
| 5,464,070 | A | 11/1995 | Griek et al. | |
| 5,694,720 | A | 12/1997 | Walcher et al. | |
| 5,833,180 | A | 11/1998 | Baranowski | |
| 6,036,146 | A | 3/2000 | Paterson | |
| 6,038,829 | A | 3/2000 | Franks | |
| 6,053,281 | A * | 4/2000 | Murray | E04G 21/3223 248/237 |
| 6,173,809 | B1 | 1/2001 | Cole et al. | |
| 6,173,932 | B1 | 1/2001 | Poradzisz | |
| 6,270,057 | B1 | 8/2001 | Highley et al. | |
| 6,375,132 | B1 | 4/2002 | Tomlinson | |
| 6,439,344 | B1 | 8/2002 | Cole | |
| 6,540,209 | B2 | 4/2003 | Ross | |
| 6,585,080 | B2 | 7/2003 | Murray | |
| 6,679,482 | B2 | 1/2004 | Allenbaugh | |
| 6,722,470 | B2 | 4/2004 | Carson | |
| 6,796,539 | B2 | 9/2004 | Tilton | |
| 7,234,689 | B2 | 6/2007 | Kuenzel | |
| 7,284,746 | B2 | 10/2007 | Kuenzel | |
| 7,530,551 | B2 | 5/2009 | Kuenzel | |
| 7,806,232 | B2 | 10/2010 | Thomas et al. | |
| 7,891,618 | B2 | 2/2011 | Carnevali | |
| 7,971,838 | B2 | 7/2011 | Osborn et al. | |
| 8,235,340 | B2 | 8/2012 | Carnevali | |
| 8,448,923 | B1 | 5/2013 | Schad et al. | |
| 8,827,037 | B2 | 9/2014 | Chilton | |
| 2003/0042072 | A1 * | 3/2003 | Murray | E04G 21/3242 182/113 |
| 2006/0010673 | A1 | 1/2006 | Kuenzel | |
| 2006/0180391 | A1 * | 8/2006 | Thomas | E04G 21/3223 182/45 |
| 2006/0272889 | A1 | 12/2006 | Paquette | |
| 2007/0246299 | A1 | 10/2007 | Wright et al. | |
| 2008/0006809 | A1 | 1/2008 | Stoffels et al. | |
| 2009/0127534 | A1 | 5/2009 | Powell | |
| 2009/0196679 | A1 | 8/2009 | Parker et al. | |
| 2011/0239580 | A1 | 10/2011 | Rodewald et al. | |
| 2014/0191172 | A1 | 7/2014 | Christoffer et al. | |
| 2014/0360813 | A1 | 12/2014 | McClendon | |

FOREIGN PATENT DOCUMENTS

| | | | | |
|---|---|---|---|---|
| EP | 1683930 | A2 | 7/2006 | |
| EP | 3358107 | A1 | 8/2018 | |
| GB | 2099061 | A * | 12/1982 | E04G 21/3219 |
| GB | 2101187 | A | 1/1983 | |
| GB | 2291920 | B | 2/1996 | |
| GB | 2384023 | A | 7/2003 | |
| WO | WO-9109191 | A1 * | 6/1991 | |
| WO | WO 2004/015219 | A1 | 2/2004 | |
| WO | WO 2011/076559 | A1 | 6/2011 | |

* cited by examiner

ROOF EDGE SAFETY SYSTEM

CROSS REFERENCE TO RELATED APPLICATIONS

The present application claims the benefit of U.S. provisional patent application 63/329,290 filed Apr. 8, 2022 of like title, the teachings and entire contents which are incorporated herein by reference.

BACKGROUND OF THE INVENTION

1. Field of the Invention

The present invention pertains generally to safety devices, and more particularly to temporary protective expedients for buildings. In a most preferred manifestation, the present invention is a roof edge safety system.

2. Description of the Related Art

When working on top of buildings, one of the inevitabilities is the risk of a worker succumbing to gravity, further compounded by the great distance from the ground. When a person is supported by the building, this risk is almost nonexistent. To ensure that a person remains on the rooftop of a building, a wide variety of equipment and techniques have been deployed.

One common support is a cable or tether connected between a safety harness and an anchor point. This approach has found widespread acceptance for some applications, particularly where footing can be challenging such as with significantly sloped roofs and early in the construction of a building when only the framing is installed. As may be appreciated, while this technique is very effective at keeping a person on the roof, the cable itself is very restrictive, interfering with the person's ability to quickly and freely move about and work. In some instances, the cable will in fact create hazards, particularly when machinery and equipment are also operating on the roof or many workers are moving about. In other words, in some instances the cable anchor can actually interfere with the safety of workers on the roof.

For relatively flatter roofs and similar flatter surfaces, some artisans have solved this problem with roof-edge barriers that are designed to contain a person on the roof, in the manner of a fence or barricade. Such roof-edge barriers must be capable of retaining the weight of a worker accidentally colliding with the barrier, including a reasonable safety margin. To provide such a strong barrier, many of these are complicated temporary barriers that are bolted or screwed into the roof or building, and require substantial alignment. Others prior art systems are easy to set up, but can be prone to failure and therefore provide little protection.

One of the types of equipment deployed is a pole and flag system, which uses multiple flags on a rope, and small poles deployed against the parapet of the roof. However, the poles used for this purpose are only effective at alerting a person to the edges and will not prevent someone from falling off the edge. When the person is working on the rooftop, additional protection is highly desired, as their focus is elsewhere. They might literally step backward off of the roof and not see the flags on the rope until they are already free-falling.

Exemplary U.S. and Foreign patents and published applications, the teachings which are incorporated herein by reference, include: 350,289 by Brown, entitled "Apparatus for climbing chimneys, etc."; 354,880 by Amon, entitled "Safety attachment for scaffolds"; 404,286 by King et al, entitled "Portable balcony"; 475,054 by Ellrich, entitled "Combines standard and clamp"; 670,904 by Pittman, entitled "Lamp Supporting Bracket"; 808,602 by Fergusson, entitled "Desk Bracket"; 901,801 by Frey, entitled "Window chair"; 1,039,554 by Lindhorst, entitled "Flag holder for automobiles"; 1,165,435 by Mishel, entitled "Window cleaner's platform"; 1,189,098 by Hall, entitled "Ironing board support"; 1,239,472 by Florian, entitled "Window cage"; 1,312,399 by Heywood, entitled "Device for climbing steel columns"; 1,550,472 by Typanski, entitled "Window chair"; 1,556,835 by Huhn, entitled "Window seat"; 2,001,796 by Paulus, entitled "Adjustable window seat"; 2,347,745 by McKinney, entitled "Safety saddle and scaffolding"; 2,598,130 by Mallison, entitled "Lantern Bracket"; 2,706,662 by Brown, entitled "Detachable staging stanchions"; 2,714,044 by Otani, entitled "Combined window stand and seat assembly"; 2,805,103 by Jovais, entitled "Window scaffold"; 3,084,759 by Squire, entitled "Removable guard rail stanchion"; 3,424,412 by Gayle, entitled "Mounting bracket for outboard motors"; 3,480,242 by Cleveland, entitled "Removable stanchion"; 3,480,257 by Bourn et al, entitled "Guard rail stanchion"; 3,632,089 by Smith, entitled "Safety barrier post"; 3,747,898 by Warren, entitled "Guard rail post"; 3,756,568 by Mocny et al, entitled "Removable guard rail stanchion"; 3,863,899 by Werner, entitled "Removable guard rail"; 3,863,900 by Dagiel et al, entitled "removable guard rail assembly and stanchion bracket therefor"; 3,880,405 by Brueske, entitled "Portable, personnel guard rail"; 3,938,619 by Kurabayashi et al, entitled "Stanchion"; 3,980,278 by Elias, entitled "Interlocking safety fence post and panel"; 3,995,833 by McLaughlin et al, entitled "Removable guard rail stanchion apparatus"; 3,995,834 by Melfi, entitled "Support for guard rails"; 4,037,824 by Whitmer, entitled "Safety post"; 4,669,577 by Werner, entitled "Slab clamp guard rail post"; 4,917,249 by King, entitled "Collapible clothing rack"; 5,029,670 by Whitmer, entitled "Frame erection safety system and components thereof"; 5,255,799 by Haynes, entitled "Portable billard cue holder"; 5,263,550 by Jines et al, entitled "Railing for portable staging"; 5,307,897 by Turner et al, entitled "Safety stanchion for fall protection system"; 5,353,891 by Griek et al, entitled "Stanchion assembly"; 5,433,044 by Walcher et al, entitled "Safety clamp for standing seam roof"; 5,464,070 by Griek et al, entitled "Stanchion assembly"; 5,694,720 by Walcher et al, entitled "Standing clamp for standing seam roof"; 5,833,180 by Baranowski, entitled "Computer mouse operation pad and forearm support assembly"; 6,036,146 by Paterson, entitled "Safety cable system"; 6,038,829 by Franks, entitled "Adaptable safety rail system for flat roofs and parapets"; 6,173,809 by Cole et al, entitled "Safety stanchions"; 6,173,932 by Poradzisz, entitled "mounting device for mounting a hand tying device to a bale of compressed material"; 6,270,057 by Highley et al, entitled "Reuseable multi-story building construction guardrail system"; 6,375,132 by Tomlinson, entitled "Electric iron safety stand"; 6,439,344 by Cole, entitled "Concrete mounted safety stanchion and apparatus and methods for mounting to concrete"; 6,540,209 by Ross, entitled "Portable safety fence system for construction sites"; 6,585,080 by Murray, entitled "Modular stanchion holder for removable guard rail system"; 6,679,482 by Allenbaugh, entitled "Construction perimeter guard"; 6,722,470 by Carson, entitled "Anchorage adapter, systems and methods for use in fall protection"; 6,796,539 by Tilton, entitled "Apparatus for fastening containers for plants and storage onto balusters"; 7,234,689 by Kuenzel, entitled "Clamping apparatus and apparatus for use in erecting temporary guard rails"; 7,284,746 by Kuenzel, entitled "Clamping apparatus and apparatus for use in erecting temporary guard rails"; 7,530,551 by Kuenzel, entitled "Clamping apparatus and apparatus for use in erecting temporary guard rails"; 7,806,232 by Thomas et al, entitled "Roof perimeter cable guard system"; 7,891,618 by Carnevali, entitled "Convertible-clamp"; 7,971,838 by Osborn et al, entitled "Flange-engaging clamp"; 8,235,340 by Carnevali, entitled "portable Aviation Clamp"; 8,448,923 by Schad et al, entitled "Elevated surface safety base and post apparatus"; 8,827,037 by Chilton, entitled "Safety rail system and method for using same"; 2006/0010673 by Kuenzel, entitled "Clamping apparatus and apparatus for use in erecting temporary guard rails"; 2006/0272889 by Paquette, entitled "Safety restraint system"; 2007/0246299 by Wright et al, entitled "Safety barrier stanchion"; 2008/0006809 by Stoffels et al, entitled "Safety rail system"; 2009/0127534 by Powell, entitled "Post assembly"; 2009/0196679 by Parker et al, entitled "Stanchion systems, stanchion attachment systems, and horizontal lifeline systems including stanchions systems"; 2011/0239580 by Rodewald et al, entitled "Parapet anchor"; 2012/0186909 aka 8,827,037 by Chilton, entitled "Safety rail system and method for using same"; 2014/0191172 by Christoffer et al, entitled "Metal safety rail for open floors of a building under construction"; 2014/0360813 by McClendon, entitled "Fall prevention and guardrail access point device"; Des 331,529 by Reinklou, entitled "Guard rail support for scaffolding"; AU 2012101371 by Edwards, entitled "Clamp for safety railing"; EP 1,683,930 by Ubinana, entitled "Clamp for protective railings for works"; EP 3,358,107 by Albanese, entitled "Formwork clamp"; GB 2,101,187 by Taylor, entitled "Temporary safety barriers"; GB 2,291,920 by Sneddon, entitled "Method of mounting a rail"; GB 2,384,023 by Cole, entitled "Adjustable handrail clamp for attachment to non-flat surfaces"; WO 2004/015219 by Stojanovic, entitled "Post and rail assembly"; WO 2011/076559 by Jackson, entitled "Protective rail support".

As may be apparent, in spite of the enormous advancements and substantial research and development that has been conducted, there still remains a need for a a quick-to-setup and robust edge awareness and protection apparatus which can be used without damaging the structure.

In addition to the foregoing patents, Webster's New Universal Unabridged Dictionary, Second Edition copyright 1983, is incorporated herein by reference in entirety for the definitions of words and terms used herein.

SUMMARY OF THE INVENTION

In a first manifestation, the invention is, in combination, a building and a roof edge safety system. The building comprises at least one elevational wall; at least one roof adjoining the at least one elevational wall; and a parapet adjoining with and elevated with respect to the at least one roof and the at least one elevational wall. The parapet has at least two separate parapet elevational surfaces rising above the roof and meeting at a parapet top. The roof edge safety system comprises at least one roof edge safety support and a tensioned cable. The at least one roof edge safety support has an edge clamp spanning the parapet top and applying a clamping force to the at least two separate parapet elevational surfaces. The edge clamp comprises a first contact pressing along a first force vector against a first one of the at least two separate parapet elevational surfaces, and a second contact and a third contact each pressing against a second one of the at least two separate parapet elevational surfaces along and thereby defining a second force vector, the second force vector equal in magnitude and opposed in direction to the first force vector. A clamp driver generates the clamping force. A standard adjacent to a first terminus is coupled to and rises from the edge clamp and extends therefrom to a top elevation above the parapet top. The standard has at least one rope guide, and the tensioned cable passes through the at least one rope guide.

In a second manifestation, the invention is a combination building and roof edge safety system. The building comprises at least one elevational wall; and at least one roof adjoining the at least one elevational wall. The roof edge safety system comprises at least one roof edge safety support having a fastener securing the at least one roof edge safety support to the building adjacent the roof; a standard coupled adjacent to a first terminus to and rising from the fastener and having at least one rope guide; a tensioned cable passing through the at least one rope guide; and an elevation pole having a foot configured to engage with the at least one roof, a riser rising from the foot, and at least one elevation pole rope guide affixed to the riser, the tensioned cable passing through the at least one elevation pole rope guide.

In a third manifestation, the invention is an edge safety support. The edge safety support comprises an edge clamp having a first contact configured to press along a first force vector, and a bifurcated clamp leg supporting a second contact and a third contact pressing along and thereby defining a second force vector, the second force vector equal in magnitude and opposed in direction to the first force vector. A clamp driver is configured to generate a clamping force. A standard has a first terminus and is coupled adjacent to the first terminus to and rises from the edge clamp and extends therefrom to a top elevation, and has at least one rope guide. A tensioned cable passes through the at least one rope guide.

OBJECTS OF THE INVENTION

The present invention and the preferred and alternative embodiments have been developed with a number of objectives in mind. While not all of these objectives are found in every embodiment, these objectives nevertheless provide a sense of the general intent and the many possible benefits that are available from embodiments of the present invention.

A first object of the invention is to provide a quick-to-setup, relatively inexpensive, and robust edge awareness and protection apparatus which can be used without damaging a static structure. A second object of the invention is that the edge awareness and protection apparatus be easy and intuitive to install, using either no tools or tools commonly available at a work site, to a variety of building parapets and other structures having large drops. Another object of the present invention is that the edge awareness and protection apparatus be both reliable and secure, with load ratings meeting or exceeding federal safety mandates. A further object of the invention is to absorb shock with flexion and distribute the load across a plurality of standards. Yet another object of the present invention is to enable work to proceed across an entire elevated surface such as a roof with nominal or no interference.

BRIEF DESCRIPTION OF THE DRAWINGS

The foregoing and other objects, advantages, and novel features of the present invention can be understood and appreciated by reference to the following detailed description of the invention, taken in conjunction with the accompanying drawings, in which.

DESCRIPTION OF THE PREFERRED EMBODIMENT

Figure 1:
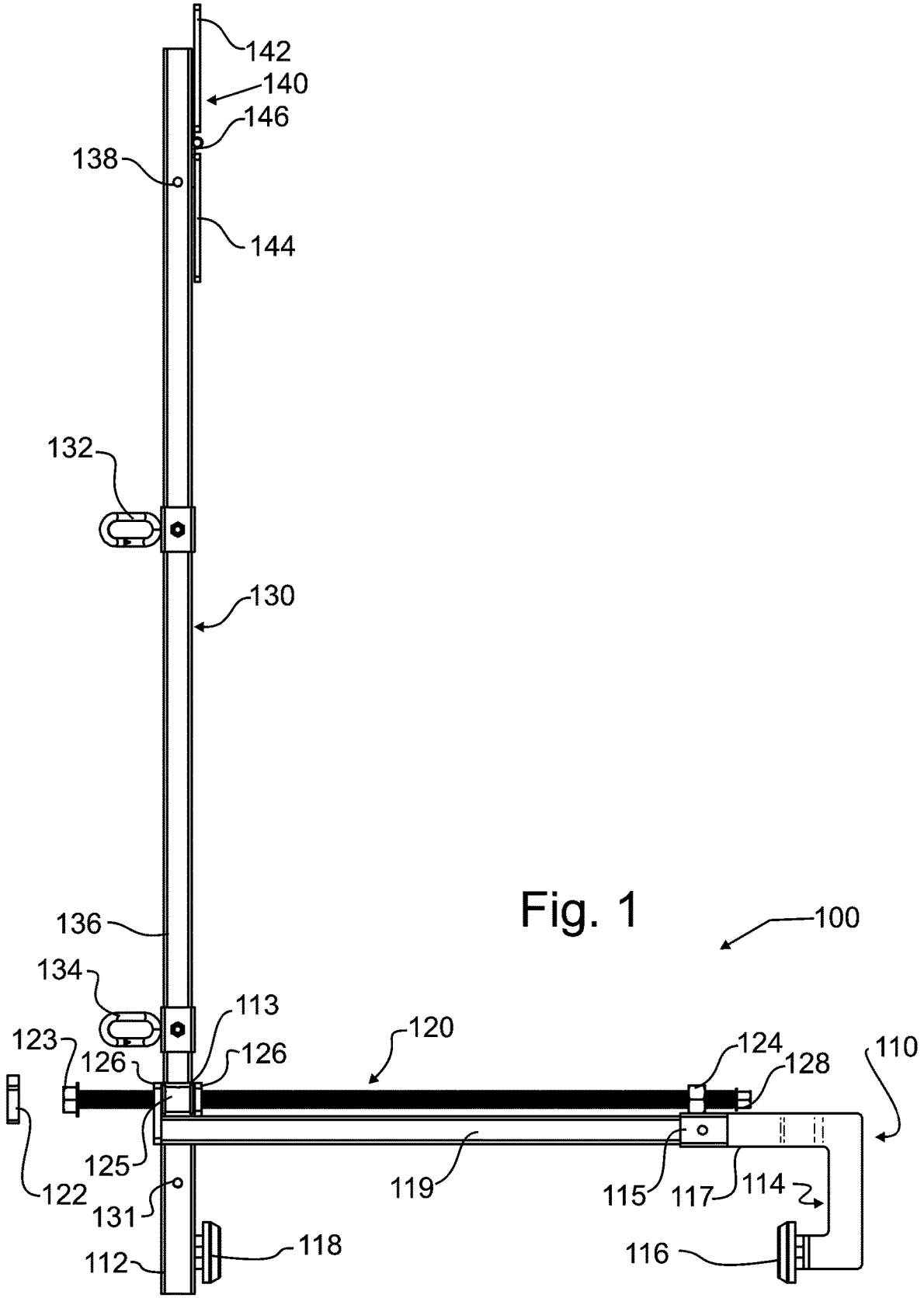
FIGS. 1, 2, and 3 illustrate a preferred embodiment roof edge safety support designed in accord with the teachings of the present invention from left side elevational view, front and left side projected view, and rear and left side projected view, respectively.

Manifested in the preferred and alternative embodiments, the present invention provides an improved roof edge safety system. In a preferred embodiment of the invention designed in accord with the teachings of the present invention and illustrated in FIGS. 1-3, a roof edge safety support 100 such as would be used in an improved roof edge safety system comprises an edge clamp 110, a clamp driver 120, a standard 130, and an edge safety standard anchor 140.

Edge clamp 110 has a stationary clamp leg 112 having a flared top opening 113 that leads into the interior of stationary clamp leg 112. A bifurcated moving clamp leg 114 has a tubular body 115, and a pair of arms each leading from tubular body 115 that each terminates at one of a pair of moving contacts 116. A stationary contact 118 is suspended from stationary clamp leg 112 by an optional resilient coupler 111. A longitudinally extensive slide 119 rounds out the primary edge clamp 110 components.

Tubular body 115 is configured to slide in a reciprocating manner along longitudinally extensive slide 119. Tubular body 115 and longitudinally extensive slide 119 are illustrated as each comprising a square cross-section tube. This geometry is preferred owing to a combination of the ready availability and relatively low cost of square cross-section tubes, the high strength to weight ratio of such tubing which helps to reduce both the finished weight of preferred embodiment roof edge safety support 100 and the consumption of materials required for fabrication, and the complementary four faces that prevent rotation of tubular body 115 about slide 119. However, in some alternative embodiments tubular body 115 and slide 119 each have a cross-section that is still polygonal, but in some of these embodiments each have more faces than the four illustrated, and in others of these embodiments each have fewer faces than the four illustrated. In yet other alternative embodiments, other non-polygonal cross-sections are used, and suitable apparatus, for exemplary and non-limiting purpose such as a key and a slide configured to receive the key or yet other complementary geometries that prevent relative rotation of the tubular body 115 about the longitudinal axis of slide 119 are provided. In some alternative embodiments, slide 119 is solid. In yet other alternative embodiments, one of the many linear bearings and equivalents thereof known in the mechanical arts is used instead of the combination of tubular body 115 and slide 119.

Edge clamp 110 is configured to clamp about the end or edge of a protruding wall, such as a parapet or the like. The lower surface of tubular body 115 defines wall-top contact surface 117, meaning that, during installation of preferred embodiment roof edge safety support 100, wall-top contact surface 117 is desirably resting on or at least immediately adjacent to the wall top. By locating contacts 116, 118 some distance below the wall-top contact surface 117, top caps or other structure that is wider than the portion of the wall being clamped about will not interfere with proper operation of edge clamp 110.

Contacts 116, 118 are preferably fabricated from a relatively high durometer elastomer or rubber to provide a combination of high surface contact friction and simultaneous nominal deformation at clamping force around surface imperfections in the object being clamped to. For exemplary and non-limiting purpose, brick, concrete, stucco, and other building materials can have a substantial amount of surface texture that would interfere with secure clamping if contacts 116, 118 are incapable of deformation.

When edge clamp 110 is secured about a parapet or the like, there is a likelihood that when most needed, edge clamp 110 will be exposed to very short term high momentum impacts. By incorporating some resilience in stationary clamp leg 112 and moving clamp leg 114, preferred embodiment roof edge safety support 100 is better able to absorb high momentum impacts. In consideration thereof, a resilient coupler 111 is provided intermediate between stationary clamp leg 112 and stationary contact 118. As illustrated, resilient coupler 111 is simply a flat metal strap with a ninety-degree bend intermediate between ends. However, when a large force is applied thereto, resilient coupler 111 will nominally flex and in so doing, decrease the peak force that is transmitted through edge clamp 110. The illustrated geometry of the wings extending from tubular body 115 also offer similar resilience. While providing both of these features is preferred, in alternative embodiments only one of the resilient coupler 111 and resiliency in the wings extending from tubular body 115 will be provided, and in yet other less desirable alternative embodiments, neither of these resilient features will be provided.

Clamp driver 120 is configured to provide the clamping forces to edge clamp 110. A threaded rod 121 has a rigidly affixed driving hex 123 affixed at one end. Driving hex 123 is configured to be driven by any suitable socket or nut driver, and so may be readily actuated by a hand-held and battery-powered driver. This makes the clamping process very quick and easy, and not complicated. For some embodiments, an optional manually driven handle 122 is provided that is either configured to engage with driving hex 123 or in alternative embodiments is directly affixed to threaded rod 121.

Adjacent to driving hex 123, a sleeve 125 is also rigidly affixed to threaded rod 121. Threaded rod 121 passes through openings in a pair of sleeve locating plates 126 that are located on both sides of sleeve 125. Sleeve locating plates 126 are rigidly affixed to one or both of stationary clamp leg 112 and tubular slide 119. These sleeve locating plates 126 prevent sleeve 125 from moving in either direction parallel to the longitudinal axis relative to slide 119, which in turn fixes the position of threaded rod 121. While preventing longitudinal movement, this combination of sleeve locating plates 126 and sleeve 125 permit rotation of threaded rod 121 about the rod's longitudinal axis. In some alternative embodiments, sleeve 125 is replaced by a pair of spaced-apart washers, each rigidly affixed to threaded rod 121.

As evident from the Figures, moving block 124 is located intermediate along threaded rod 121, between stop 128 and the sleeve locating plate 126 most distal to driving hex 123. Since sleeve locating plate 126 and stop 128 are both fixed in position along threaded rod 121, these thereby define the travel limits for moving block 124. While stop 128 may take on any suitable geometry that prevents turning threaded rod 121 out of moving block 124, stop 128 is illustrated herein as having a hex geometry similar to driving hex 123, thereby permitting a person to rotationally drive threaded rod 121 from either end.

Moving block 124 is internally threaded to match the threads of threaded rod 121, and is rigidly affixed to tubular body 115. Since moving block 124 cannot rotate, when threaded rod 121 rotates then moving block 124 will reciprocate toward and away from driving hex 123, depending upon the direction of rotation of threaded rod 121. Moving block 124 as illustrated in the preferred embodiment comprises a hex nut. Nevertheless, any suitable geometry may be used, so long as the critical features are preserved.

Because moving block 124 is rigidly affixed to tubular body 115, reciprocation of moving block 124 will cause reciprocation of tubular body 115 along tubular slide 119. As driving hex 123 is turned to tighten edge clamp 110, moving block 124 pulls moving clamp leg 114 until moving contacts 116 engage with the parapet and thereby friction clamp to the roof parapet with the opposing force of stationary contact 118. Particularly when a person uses a battery or otherwise powered driver to turn driving hex 123, moving contacts 116 will be quickly drawn closer to or moved farther from stationary contact 118 depending upon the direction of rotation, allowing the person to very quickly engage or disengage edge clamp 110. As should now be more fully appreciated, clamp driver 120 is preferred for simplicity and speed of operation. Nevertheless, in some alternative embodiments other means of actuating a clamp as known in the mechanical arts will be used.

Edge clamp 110 and clamp driver 120 form a solid and secure attachment to the roof parapet or other similar anchor point. Once anchored, additional structure must be provided to provide for the safety of workers and other persons. To this end, and either before but more commonly after affixing edge clamp 110 and clamp driver 120 to the building, a standard 130 is inserted into and supported by stationary clamp leg 112. To facilitate rapid insertion, and as aforementioned, a flared top opening 113 is formed into stationary clamp leg 112. This flare allows an end of standard 130 including a button spring pin 131 to simply be slid or dropped in. As button spring pin 131 drops toward stationary contact 118, it will be automatically compressed. When standard 130 is inserted sufficiently into and supported by stationary clamp leg 112, button spring pin 131 will pop out of a hole formed into stationary clamp leg 112, thereby locking standard 130 into stationary clamp leg 112. Consequently, a person will only need to slide standard 130 down into flared top opening 113 until button spring pin 131 pops into place.

Figure 2:
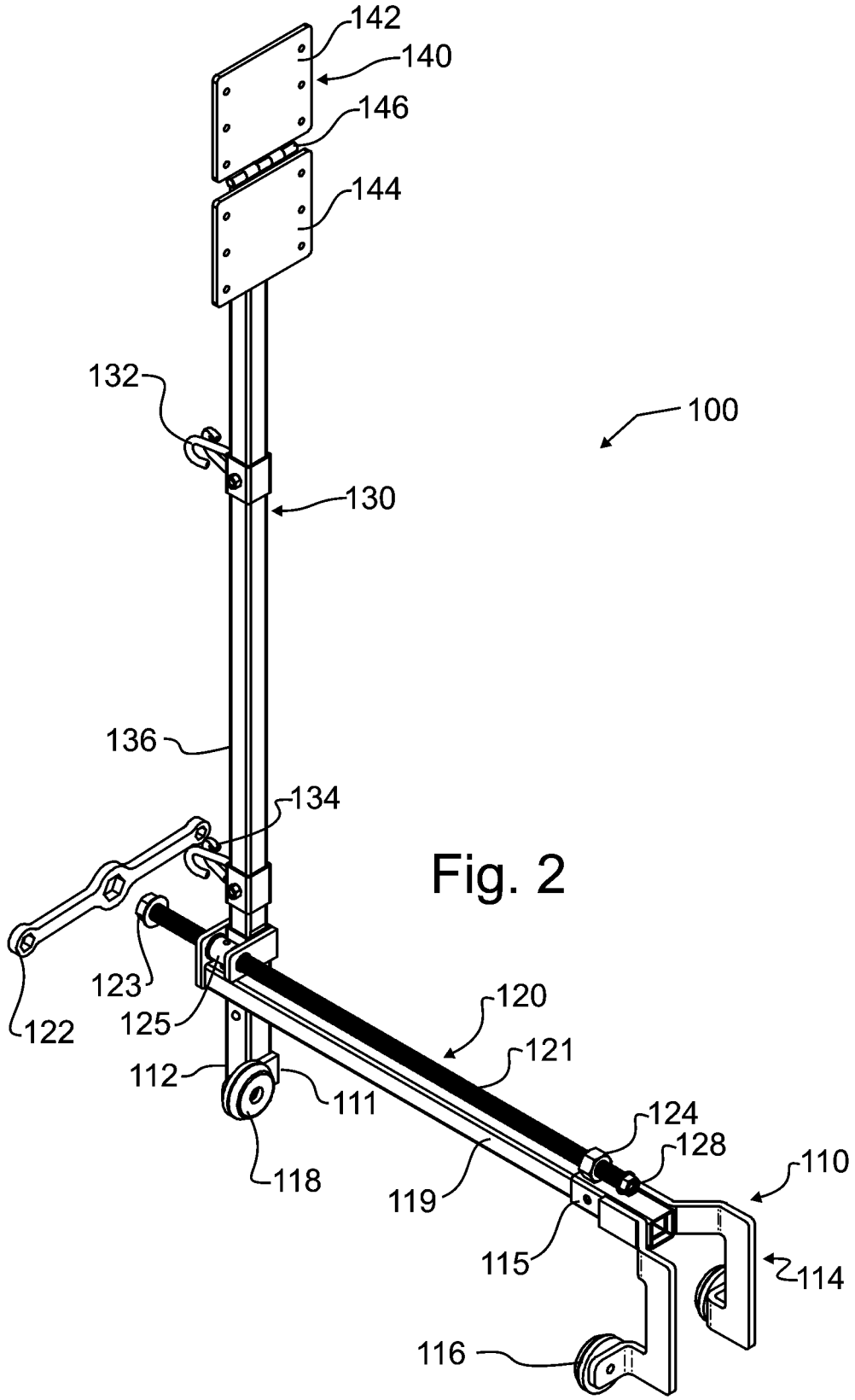
Figure 3:
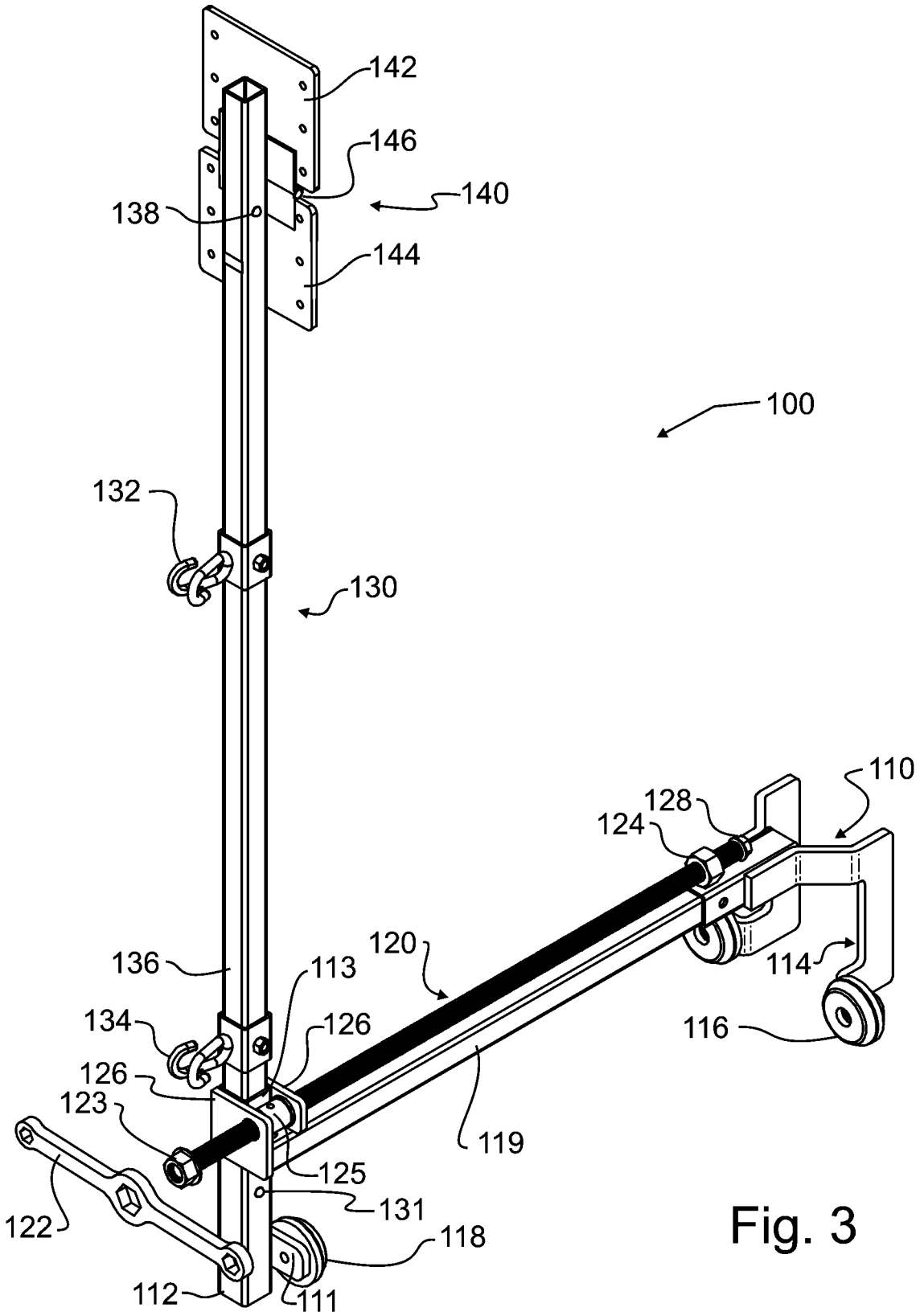

Intermediate along standard 130 are one or more rope guides 132, 134 that are configured to hold a rope or cable. As illustrated in FIGS. 1-3, upper rope guide 132 and lower rope guide 134 are provided, though it will be apparent that any number may be provided and the length of tubular body 136 may be varied, both to suit a particular need. Tubular body 136 is preferably a square cross-section tube similar to tubular body 115 and tubular slide 119, for the same reasons and benefits, but with the understanding that the alternative embodiments for the geometry of tubular body 115 and tubular slide 119 are equally applicable to tubular body 136.

In some embodiments, these rope guides 132, 134 are rigidly affixed in location by a suitable fastener passing entirely through a hole in tubular body 136. In such embodiments, the locations are preferably predetermined by the holes formed into tubular body 136. While in some alternative embodiments the positions are formed by self-tapping hardware, a concern is that if the positions are changed at a later date, the number and spacing of the holes can cause unpredictable weakening in tubular body 136. Consequently preformed holes, for exemplary and non-limiting purpose with removable pins passing through, are preferred since the geometry, wall thickness, and resultant strength and resilience of tubular body 136 can be calculated in advance taking into account such holes. In other embodiments a suitable fastener, which for exemplary and non-limiting purposes may comprise a bolt or set screw, is used to tighten against the exterior of tubular body 136, thereby allowing an infinite number of height positions while not materially affecting the strength of tubular body 136. In yet other alternative embodiments, the number and positions of rope guides such as 132, 134 are both predetermined and rigidly fixed. In such embodiments the rope guides are rigidly positioned and affixed, such as at the factory, by welding or other suitable fastener.

Figure 8:
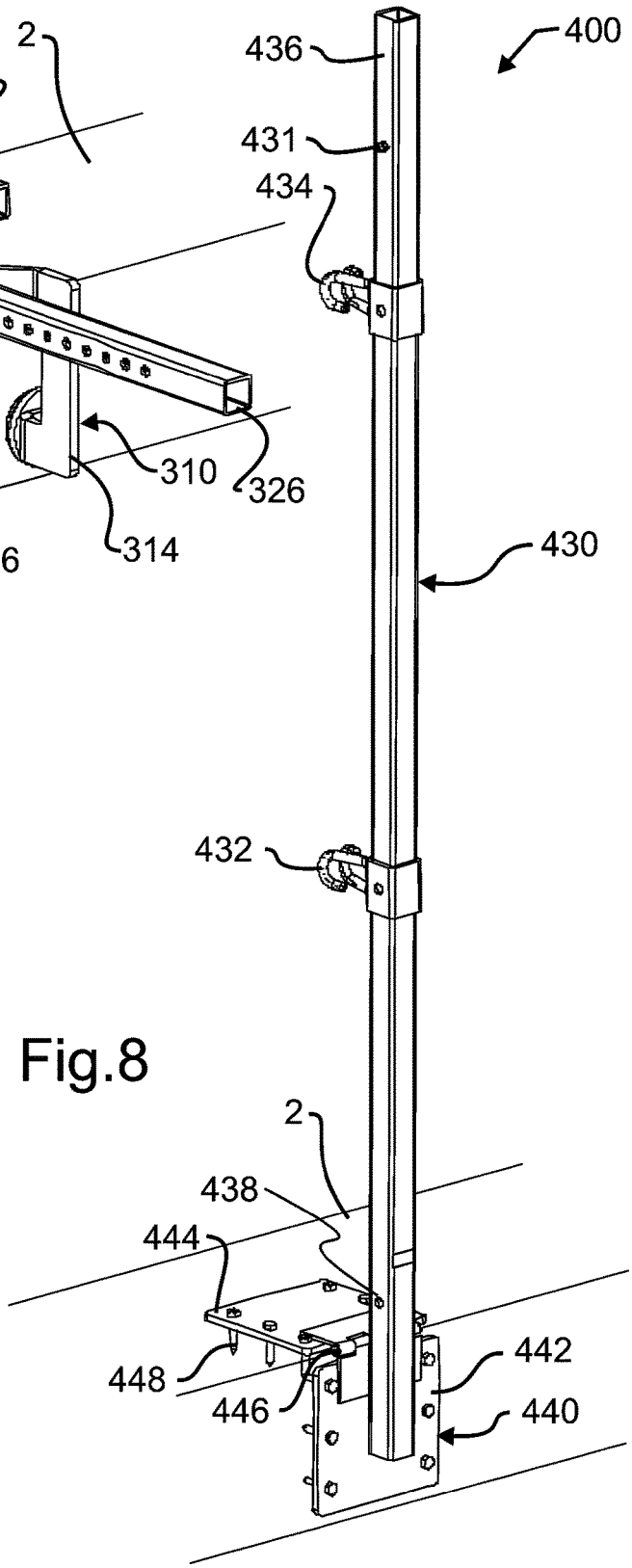
FIG. 8 illustrates an alterative embodiment roof edge bar from a projected view.

At an end of tubular body 136 distal to button spring pin 131 is an edge safety standard anchor 140. Edge safety standard anchor 140 is intended to be used in situations where for one reason or another there is a lack of one or more of ability, opportunity or desire to clamp to the parapet. Such use is illustrated in FIG. 8 and described in more detail herein below with respect to that FIGURE.

Various embodiments of apparatus designed in accord with the present invention have been illustrated in the various figures. The embodiments are distinguished by the hundreds digit, and various components within each embodiment designated by the ones and tens digits. However, many of the components are alike or similar between embodiments, so numbering of the ones and tens digits have been maintained wherever possible, such that identical, like or similar functions may more readily be identified between the embodiments. If not otherwise expressed, those skilled in the art will readily recognize the similarities and understand that in many cases like numbered ones and tens digit components may be substituted from one embodiment to another in accord with the present teachings, except where such substitution would otherwise destroy operation of the embodiment. Consequently, those skilled in the art will readily determine the function and operation of many of the components illustrated herein without unnecessary additional description.

Figure 4:
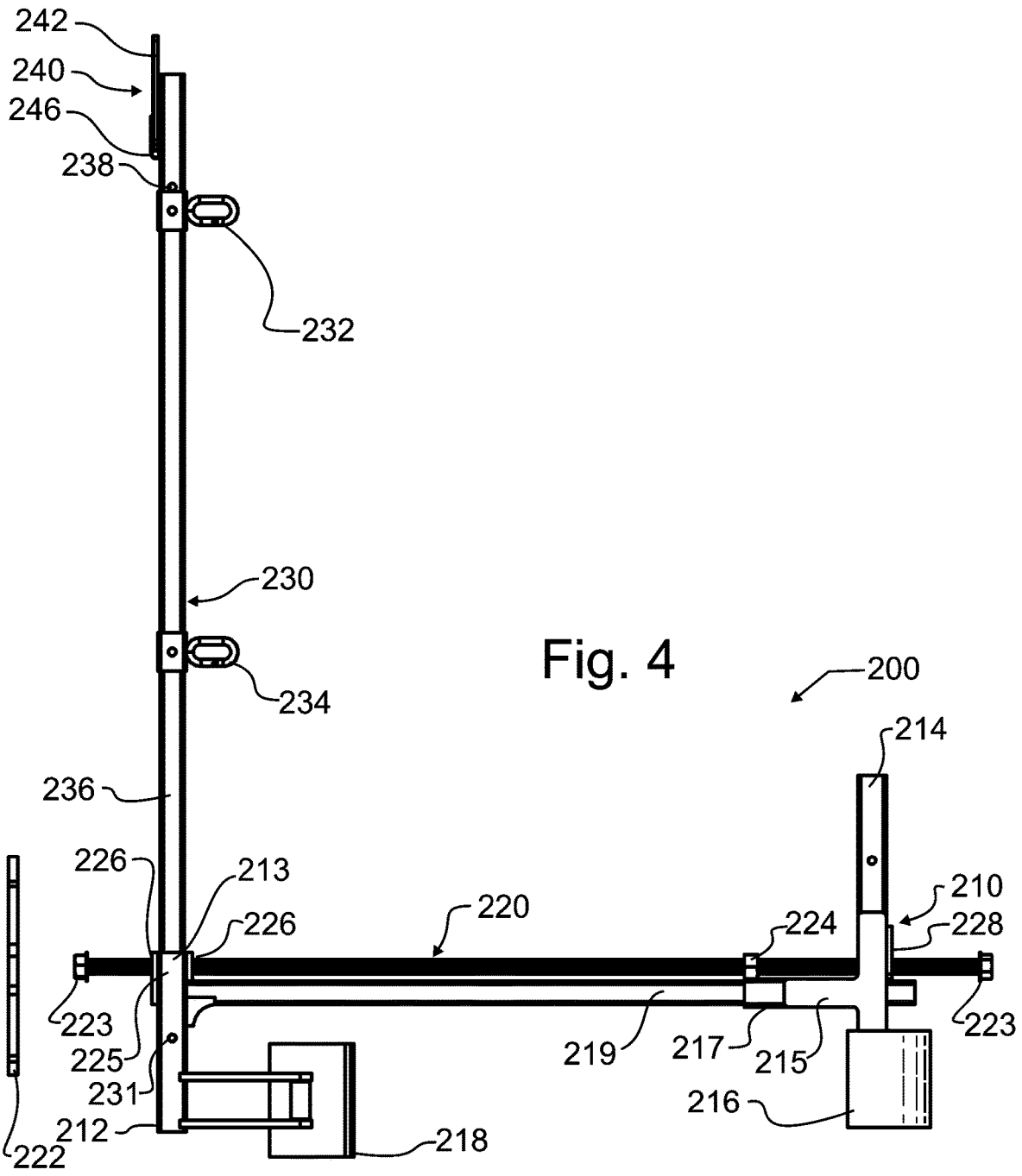
FIGS. 4, 5, and 6 illustrates an alternative embodiment roof edge safety support designed in accord with the teachings of the present invention from left side elevational view, front and left side projected view, and rear and left side projected view, respectively.
Figure 5:
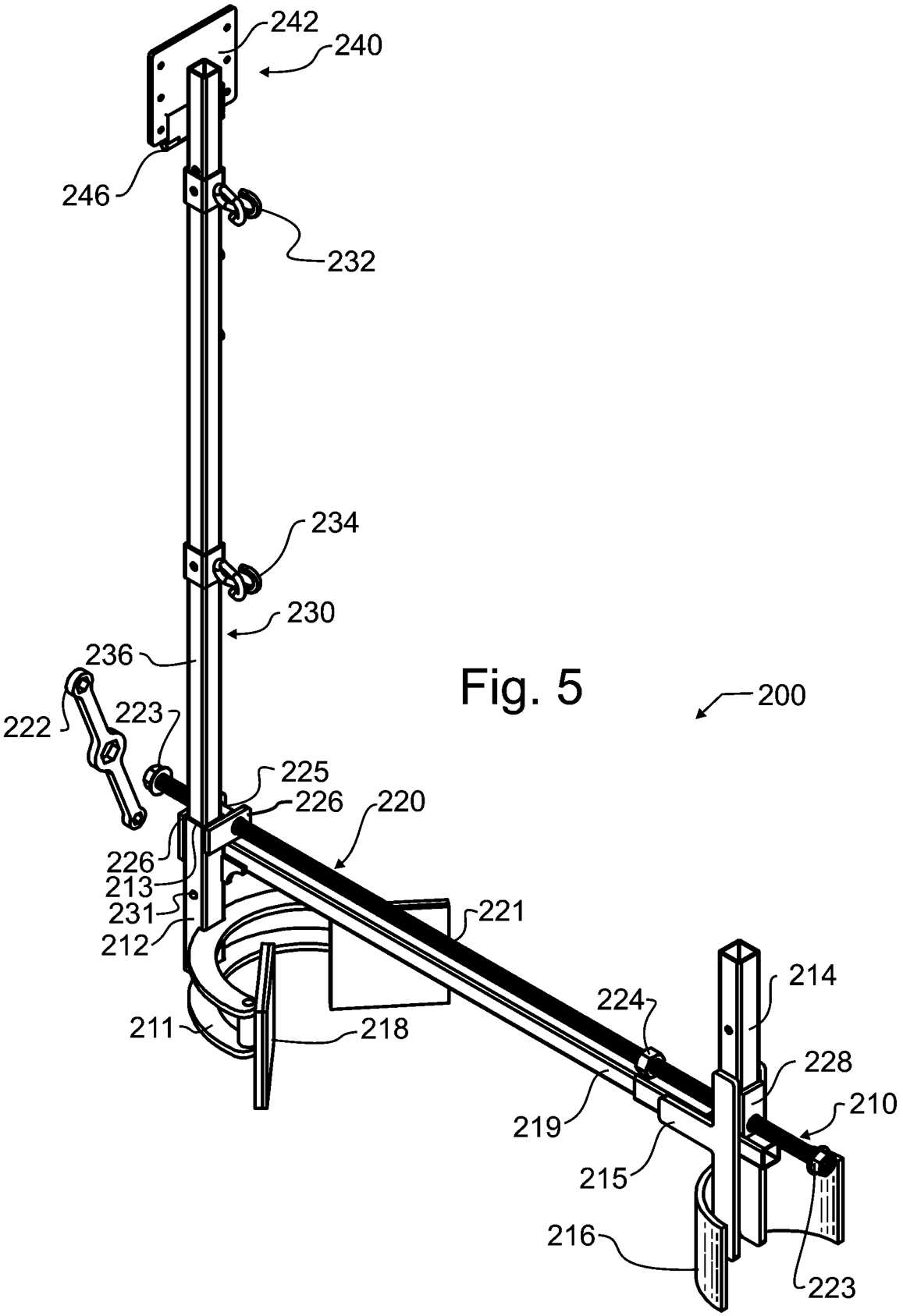
Figure 6:
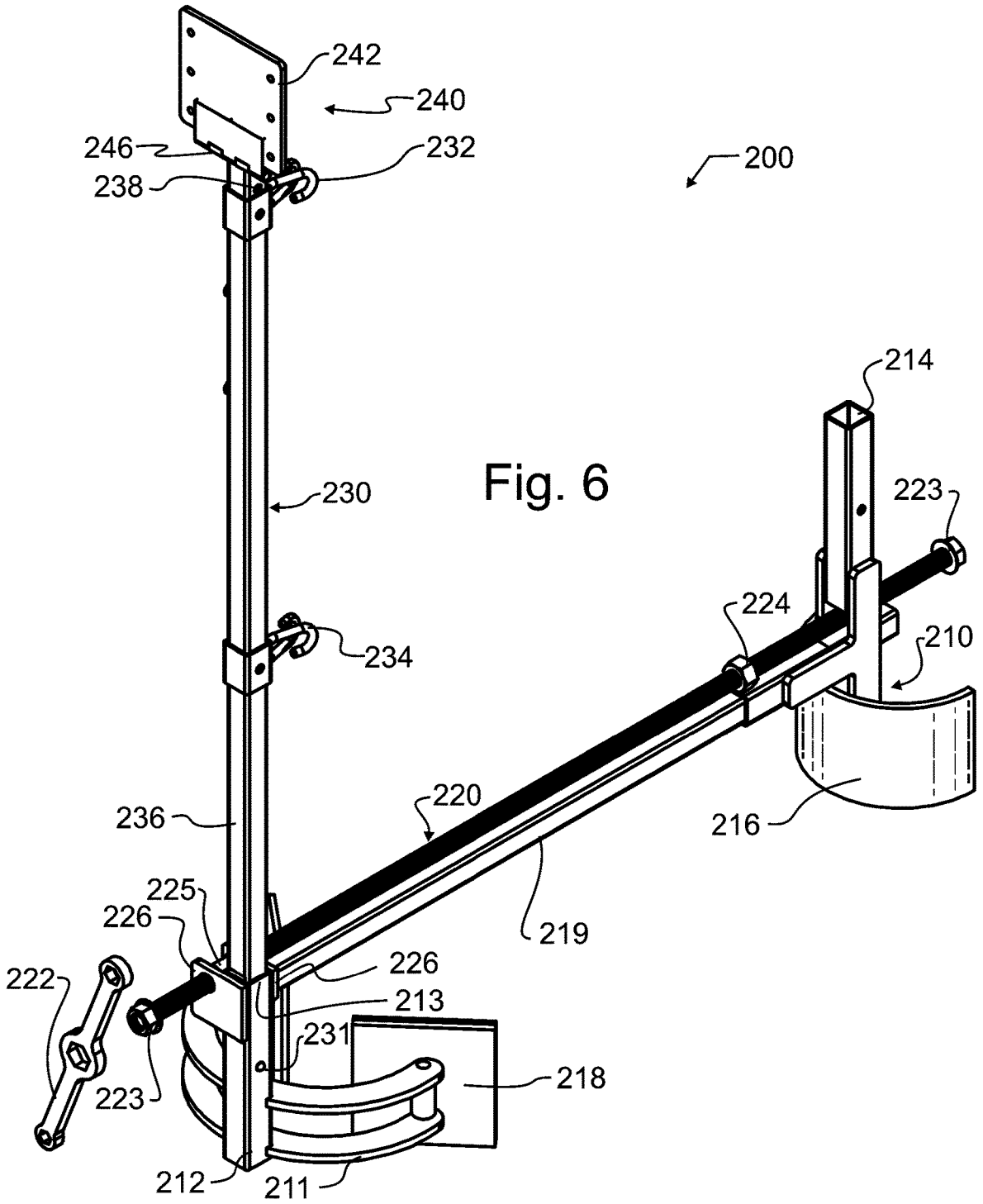

FIGS. 4, 5, and 6 illustrate an alternative embodiment roof edge safety support 200 which is optimally configured to attach to corners on roofs. While most of the parts of roof edge safety support 200 are identical or very similar to roof edge safety support 100, primary differences which will be visually apparent and thereby functionally understood are the geometry of moving contact 216, stationary contact 218, moving clamp leg 214, coupler 211, and stationary clamp leg 212. Moving clamp leg 214 includes a vertical support which can for exemplary and non-limiting purpose receive standard 230, the purpose which will become apparent with the description herein below of FIG. 10. Noteworthy also is the relocation of stop 228, which is incorporated into a plate affixed on the face of moving clamp leg 214 distal to driving hex 223.

While the design of roof edge safety supports 100, 200 are such that different units are required for straight parapet sections and corners, in some alternative embodiments a roof edge safety support will use clamp legs similar to stationary clamp leg 212 for both the stationary and moving clamp legs, thus allowing the roof edge safety support to work on both straight sections and corner sections. While this arrangement will have some drawback from using four contact points instead of three when dealing with uneven contact surfaces, in some applications the benefit of having four rotating contact pads may outweigh the drawback of having two different kinds of edge safety supports when working with some types of roofs.

In other alternative embodiments, the shape and style of the contact such as the shape of the moving contact 116 will be shaped like moving contact 216, and in other alternative embodiments, the reverse is true as well. In addition to the rounded circular shape of the contact 116 and the rectangular contact of 216, other shapes which will be found in various alternative embodiments include but are not limited to: a pyramid; a rounded surface rectangle; a polyhedron; or a rounded polyhedron.

Figure 7:
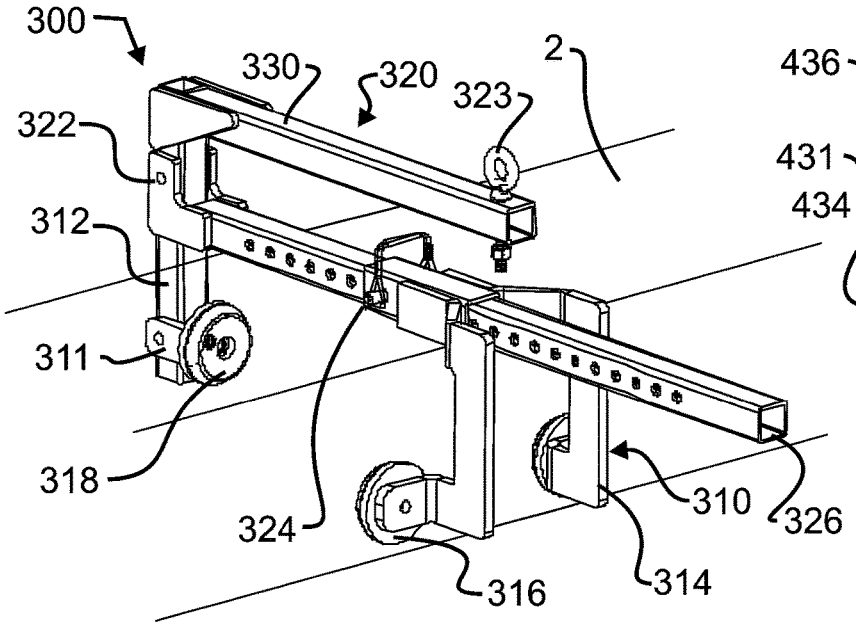
FIG. 7 illustrates an alternative embodiment roof edge clamp from a projected view.

A second alternative embodiment roof edge safety support 300 illustrated in FIG. 7 is optimally configured to anchor more securely to a parapet or roof when under a load. While the features of edge clamp 310 are very similar to edge clamp 110, clamp driver 320 is quite different. Rather than a threaded rod, clamp driver 320 uses a clamp pivot 322, a sizing pin 324, and a sizing arm 326 to gently secure about a parapet. This is done quickly and easily by using sizing pin 326 to adjust the position of moving clamp leg 314, to bring moving contact 316 into contact with the parapet. Once moving contact 316 is in contact with the parapet, then clamp driver 320 will be more tightly engaged when an upward force is applied to clamping eye 323, which pivots stationary clamp leg 312 about clamp pivot 322, thereby increasing the compression of contacts 316, 318 about the parapet, in turn more tightly holding 300 roof edge safety support in place.

Second alternative embodiment roof edge safety support 300 illustrates a standard 330 that is in the shape of the letter "L", having an approximate ninety degree turn in the middle, just above clamp pivot 322. However, it will be understood that a linear standard such as illustrated in the previous embodiments of the invention would be equally applicable. Further, the novel clamp pivot 322 illustrated in this embodiment is applicable to each of the foregoing embodiments. In such case, and with specific reference to preferred embodiment roof edge safety support 100, stationary clamp leg 112 is affixed to tubular slide 119 through a clamp pivot 322, rather than being rigidly affixed thereto. Further, in some alternative embodiments that incorporate a clamp pivot 322, rotational stops or limits are provided to limit the range of motion possible within clamp pivot 322.

As aforementioned with regard to preferred embodiment roof edge safety support 100 illustrated in FIGS. 1-3, at an end of tubular body 136 distal to button spring pin 131 is an edge safety standard anchor 140. Edge safety standard anchor 140 is intended to be used in situations where for one reason or another there is a lack of one or more of ability, opportunity or desire to clamp to the parapet. As illustrated in FIG. 8, found in the third alterative embodiment roof edge safety support 400 is standard 430, of like construction to standard 130. However, instead of insertion into stationary clamp leg 112, standard 430 is inverted and attached to parapet 2 or other roof or vertical drop structure. Where needed or desired, one or more holes 438 are provided to allow repositioning of rope guides 432, 434 when standard 430 is so inverted.

To facilitate attachment of standard 430 into a suitable building or other structure, a pair of fastening plates 442, 444 are provided and separated by a hinge 446. The provision of two plates separated by a hinge allows affixing to a variety of surfaces, and at a variety of angles. For exemplary purposes only, as illustrated in FIG. 8, fasteners 448 such as screws pass through fastening plates 442, 444 into the underlying parapet 2 structure. While the present invention is optimally configured for combination with a variety of parapet structures and geometries, it will be appreciated that other building structures and apparatuses associated with a vertical drop or roof edge may be protected using the preferred and alternative embodiments of the present invention.

Figure 9:
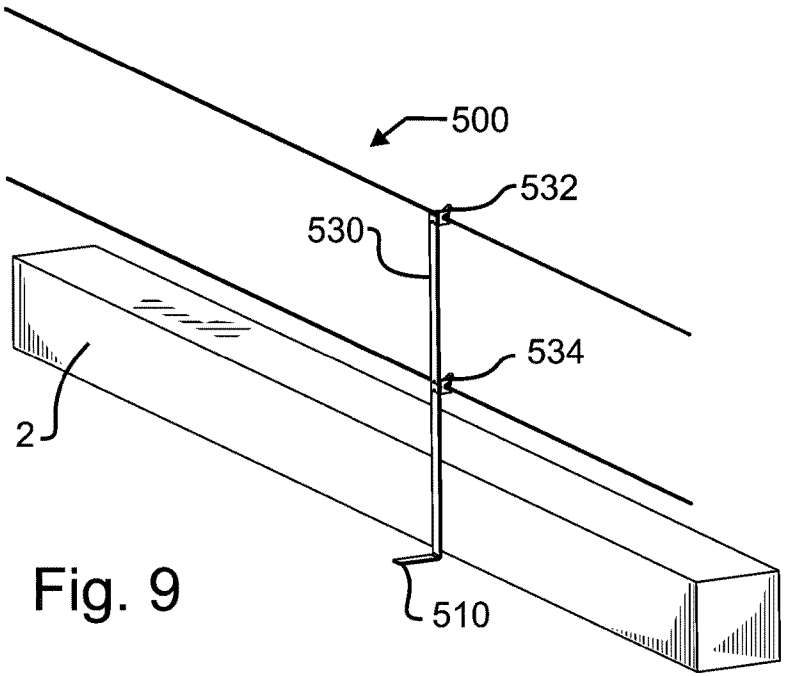
FIG. 9 illustrates an optional guide line support from a projected view.

As an adjunct to the roof edge safety supports illustrated and described herein, FIG. 9 illustrates an elevation pole 500 that has a foot 510, a riser 530, a lower rope guide 534, and an upper rope guide 532. Some of the legal requirements for safety edges include how level the guide rope or cable is maintained, and meeting particular downward force requirements on the cable. Preventing sag of the rope and increasing downward force capacity can be achieved using elevation pole 500 properly spaced to keep the ropes at a nearly constant height above the roof edge. Since foot 510 sets a minimum height, to thereby prevent sag and increase downward force capacity, and since the cable or rope passing through rope guides 532, 534 will prevent rotation of elevation pole 500, no further anchoring is required. Consequently, fewer clamps may be used in some applications where elevation poles 500 are used. Rope guides 532 and 534 illustrate the use of an alternative geometry resembling a common gate latch that also may be used in other embodiments described herein.

Figure 10:
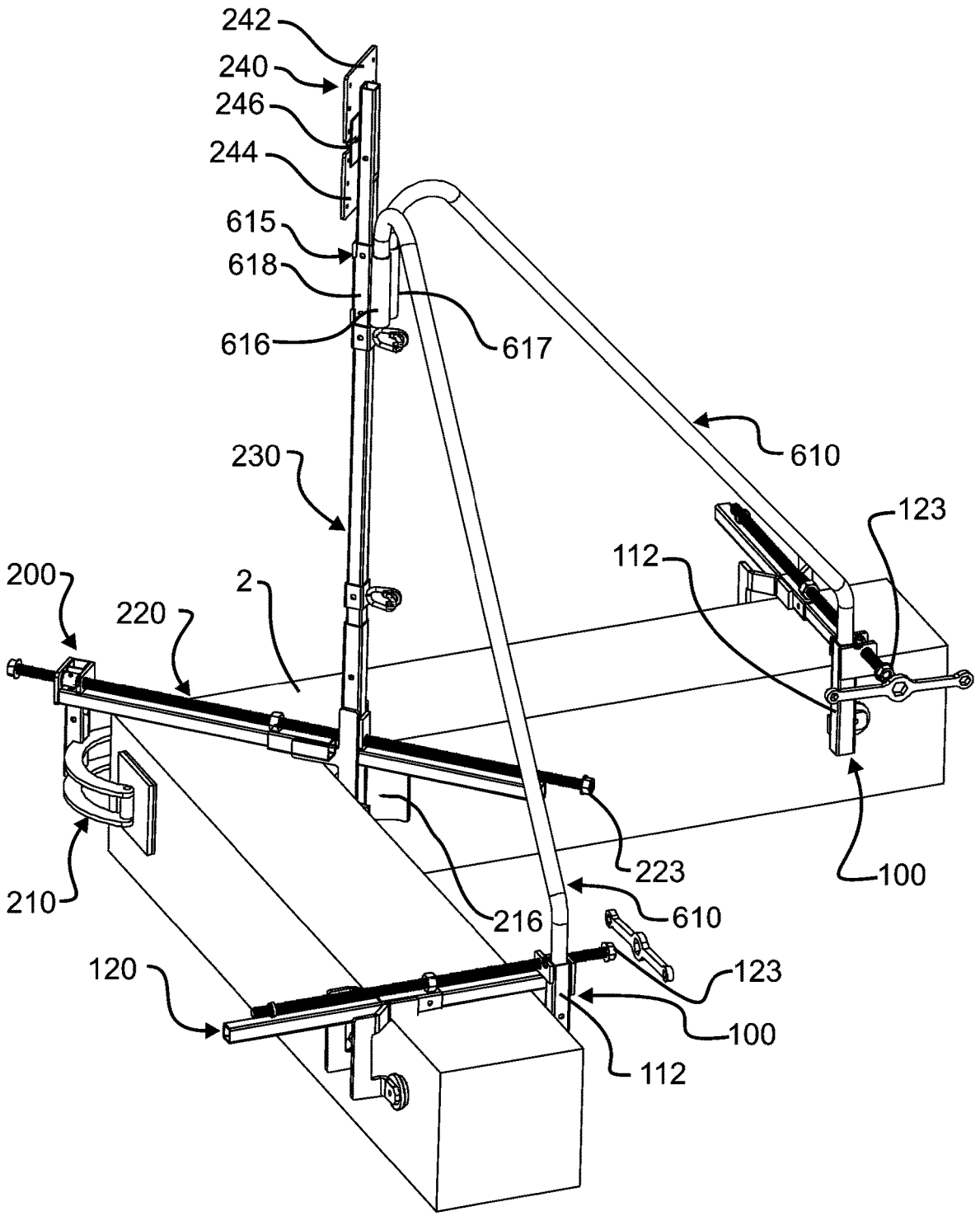
FIG. 10 illustrates a preferred embodiment roof corner safety support system combining a pair of preferred embodiment roof edge safety support of FIGS. 1-3 with the alternative embodiment roof edge safety support of FIGS. 4-6 from a projected view.
Figure 11:
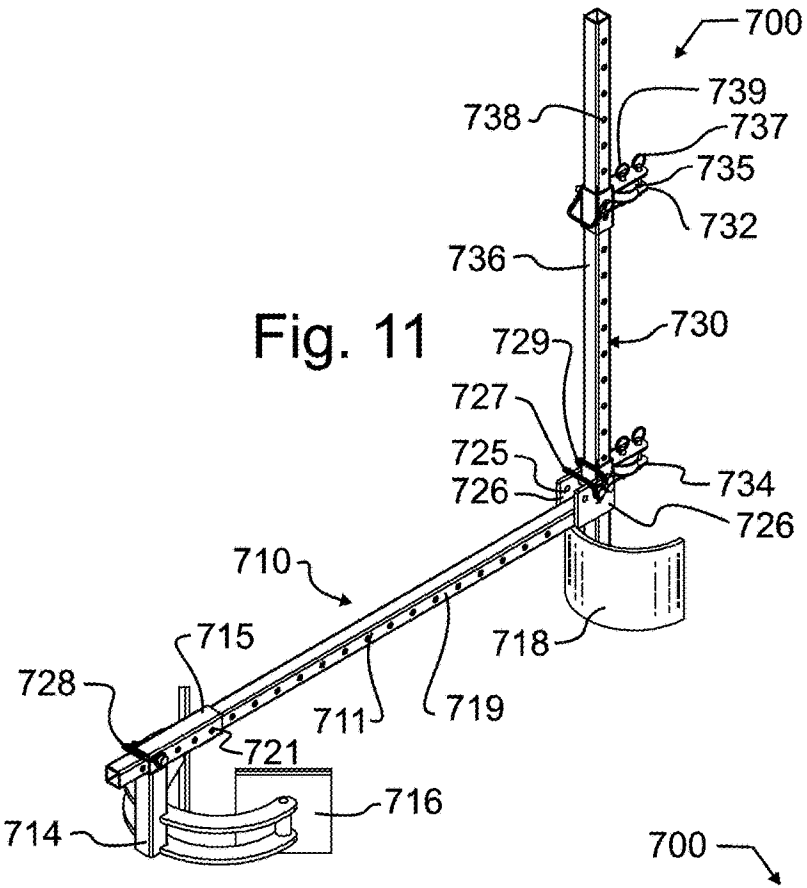
FIGS. 11, 12, and 13 illustrates an alternative embodiment roof edge safety support designed in accord with the teachings of the present invention from rear and left side projected view, left side elevational view, and top view, respectively.
Figure 12:
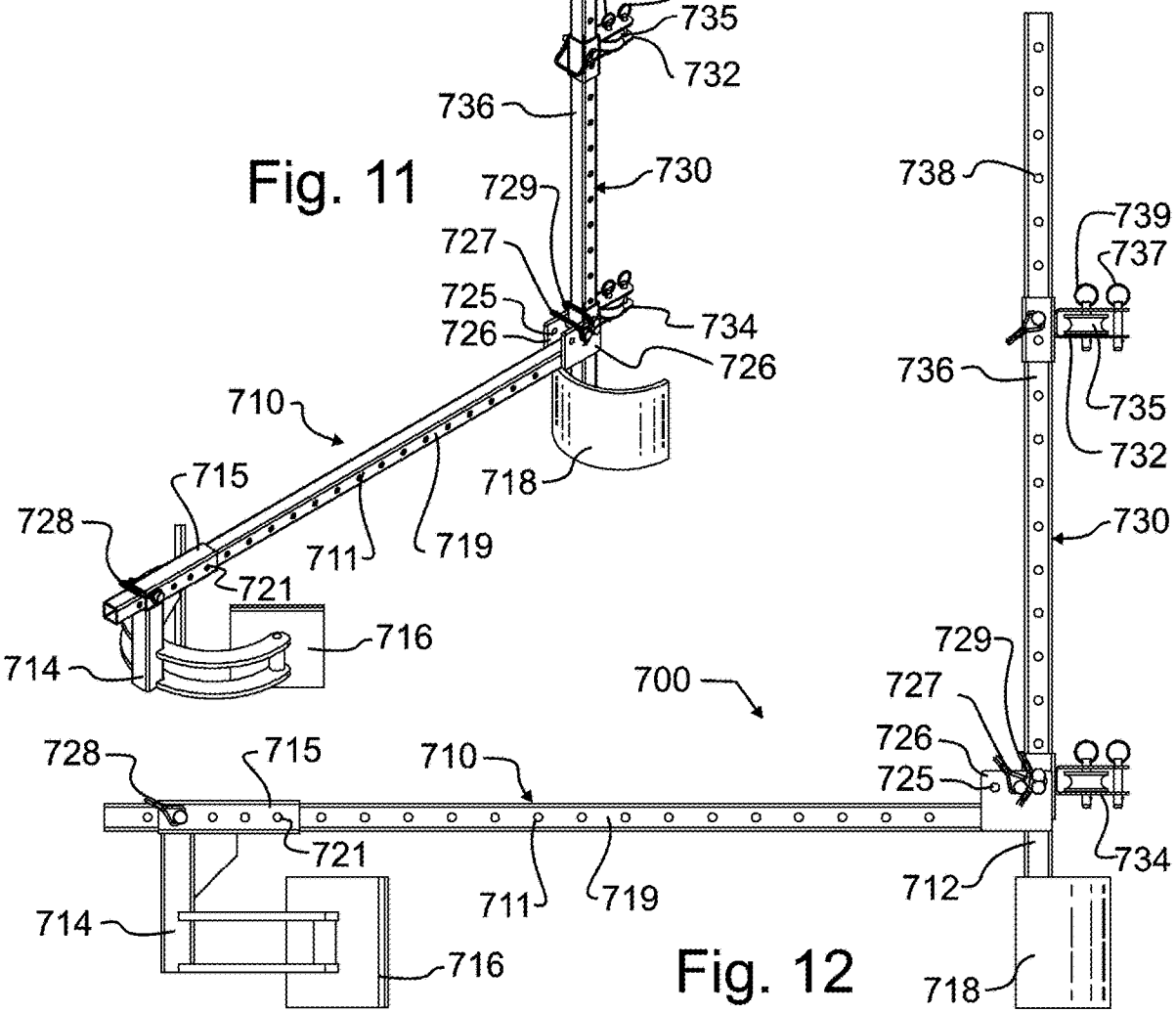
Figure 13:
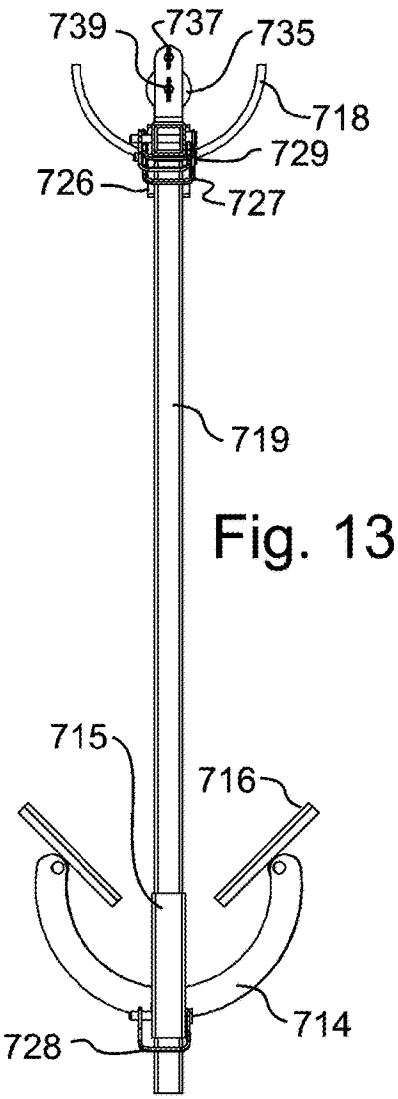

The fourth alternative embodiment roof edge safety support 600 illustrated in FIG. 10 combines two preferred embodiment roof edge safety supports 100 with and coupled to alternative embodiment roof edge safety support 200. All three of the roof edge safety supports 100, 200 are illustrated in further combination with and clamped to parapet 2. Support arms 610 couple from stationary clamp legs 112 by attaching into stationary clamp legs 112, such as sliding into flared top opening 113. Distal to stationary clamp legs 112, support arms 610 couple to standard 230 via a triple tube attachment 615. Triple tube attachment 615 has two parallel and generally cylindrical tubes 616, 617 that each receive one support arm 610, again by sliding support arms 610 down and in, and a square tube 618 that circumscribes and is rigidly affixed to standard 230. The benefit of this configuration is it provides greater stability, strength, and structure for a corner. While support arms 610 are illustrated as dropping downward into suitable sockets or coupling tubes, it will be understood that other suitable couplings may eb used, including the movement or direction of coupling.

A fifth alternative embodiment roof edge safety support 700 illustrated in FIGS. 11-15 resembles the first alternative embodiment roof edge safety support 200. However, instead of clamp driver 220, roof edge safety support 700 uses a plurality of tubular slide spacing holes 711 formed along the length of tubular slide 719 that align with ones of a plurality of tubular body spacing holes 721 formed in tubular body 715.

Figure 14:
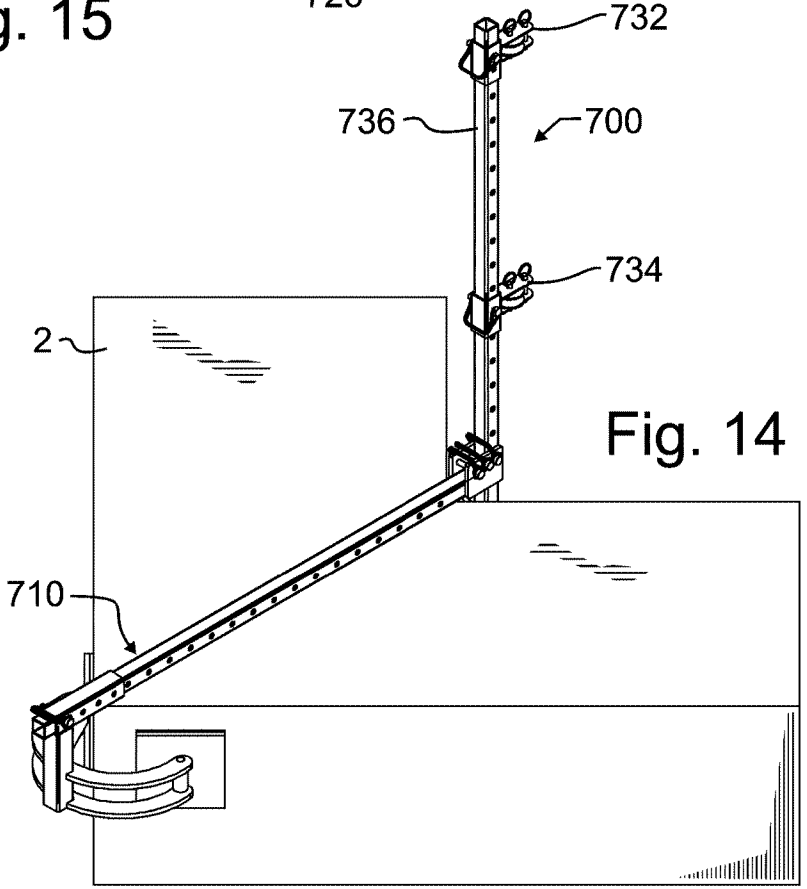
FIG. 14 illustrates the alternative embodiment roof edge safety support of FIGS. 11-13 in further combination with and installed upon a roof parapet, from a rear and left side projected view.

To secure roof edge safety support 700 to a parapet 2, such as illustrated in FIG. 14, a person may need to adjust the position of tubular body 715 relative to tubular slide 719. If adjustment is needed, the person will remove a clamp spacing locking pin 728, and next will slide tubular body 715 relative to tubular slide 719. When moving contacts 716 and stationary contact 718 are each in good contact with opposing vertical faces of parapet 2, the person may then reinstall pass clamp spacing locking pin 728 by passing the pin through an aligned combination of one tubular slide spacing hole 711 and one tubular body spacing hole 721. When stationary clamp vertical limit pin 727 is inserted into the hole as illustrated in FIGS. 11-14, pin 727 will hold standard 730 in a generally vertical position, while still allowing nominal pivoting of standard 730 about stationary clamp pivotal locking pin 729.

In this alternative embodiment roof edge safety support 700, upper rope guide 732 and lower rope guide 734 are each provided with a cable roller 735 or similar anti-friction device through which a cable or rope may pass. The roller ensures that no unwanted torque is applied about the longitudinal axis of tubular slide 719 when the rope or cable is tensioned. A cable roller retention pin 739 releasably secures cable roller 735 in place, while still allowing a cable to be threaded or removed from a rope guide 732, 734 even when there is no free end to pass through the guides, such as when the cable or rope is already tensioned through or positioned with other apparatus.

When alternative embodiment roof edge safety support 700 is fastened to a parapet 2 in the position illustrated in FIG. 14, and a cable or flag rope is subsequently passed through rope guides 732, 734 between roller 735 and tubular body 736 and then tensioned, this will provide a pulling force that tends to pivot the bottom of standard 730 and stationary contact 718 toward parapet 2. This tension in the cable or rope thereby generates a larger desired clamping force between moving contact 716 and stationary contact 718 about parapet 2. In other words, the act of tensioning a rope or cable will generate a tighter clamping action about parapet 2. In the event the cable or flag rope suddenly loses tension, either from breakage or other cause, stationary clamp vertical limit pin 727 holds standard 730 in a generally vertical position and thereby prevents standard 730 from falling down or pivoting suddenly, thereby also tending to hold roof edge safety support 700 in place.

In some applications, it may be desirable to run the cable or flag rope on the other side of roller 735 away from tubular body 736. In such instances, a second back-up cable retaining safety pin 737 is provided to ensure that the cable or rope stays within the rope guide. As with previous embodiments, holes 738 allow a person to adjust the height of upper rope guide 732 and lower rope guide 734.

Figure 15:
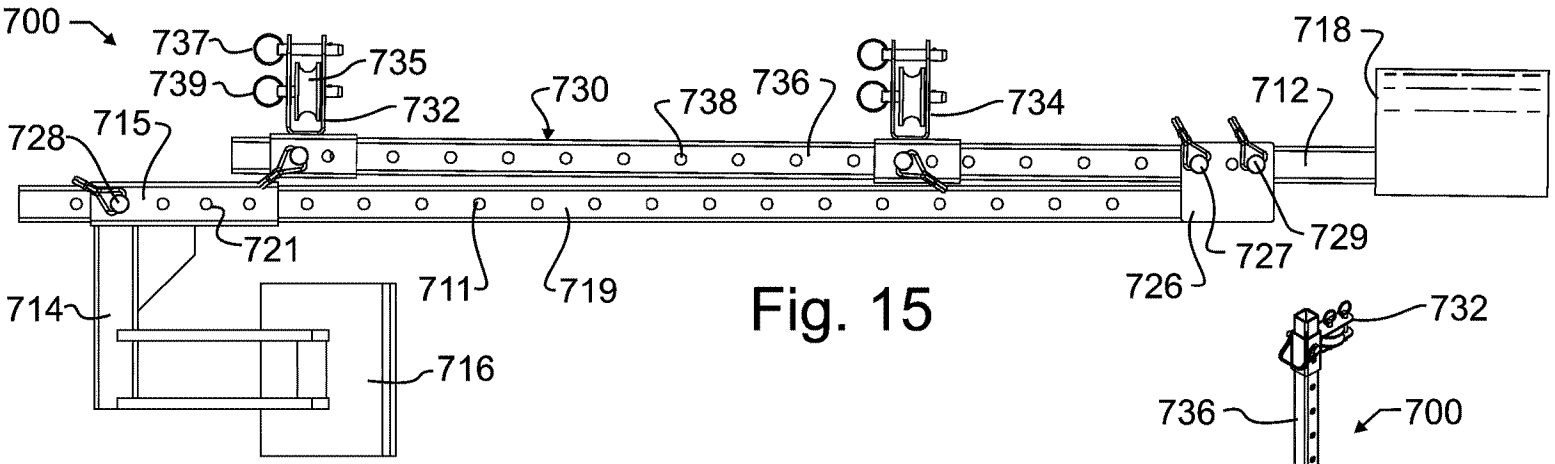
FIG. 15 illustrates the alternative embodiment roof edge safety support of FIGS. 11-13 in a folded transport and storage configuration, from a side elevational view.

Stationary clamp locating plates 726 are rigidly affixed with tubular body 736. In addition to the two holes that contain stationary clamp vertical limit pin 727 and clamp spacing locking pin 728, a stationary clamp horizontal locking hole 725 is also provided. When a person no longer requires alternative embodiment roof edge safety support 700 to be in an operative position as illustrated in FIG. 14, and instead wants to store or transport roof edge safety support 700, they may remove vertical limit pin 727, pivot tubular slide 719 about stationary clamp pivotal locking pin 729 into longitudinal alignment substantially parallel with tubular body 736, and then insert vertical limit pin 727 into stationary clamp horizontal locking hole 725 and simultaneously through a one of holes 738. This sequence results in a folding and locking of roof edge safety support 700 into a compact storage and transport configuration as illustrated in FIG. 15.

In this alternative embodiment roof edge safety support 700, no edge safety standard anchor 740 has been illustrated, but in some alternative embodiments will be implemented in accord with the teachings herein above with regard to edge safety standard anchors of the previous embodiments.

The preferred and alternative embodiment roof edge safety supports provide many benefits. One very basic benefit is that these roof edge safety supports have rope or cable mounts that can support flags to alert workers to the edge of the roof. While this first benefit may be found in small poles or dowels deployed in the prior art, roof edge safety supports designed in accord with the teachings of the present invention also will substantially stop a worker from falling over the edge of the roof, even if they do not see the flags. This ability is made possible by the improved clamping of the preferred embodiment roof edge safety supports. Furthermore, the shape and position of the edge safety support 100 is such that a force pushing from on the roof to off the roof requires the stationary contact 118 to lift over the edge of the parapet in order for it to fail, which gains the assistance of both gravity and, where present, caps and the like that enlarge the top of the parapet. Using the three points of contact, such as provided by contacts 116, 118, many of the presently disclosed edge clamps can be attached to walls with uneven surfaces, such as hewn stone or rough face block or brick. As an added benefit, and in spite of the substantially increased clamping forces that may be used, the edge clamps of the present invention are designed to minimize or eliminate any damage to a parapet.

Provision of a driving hex enables various screw, impact, and similar drivers to be used to install roof edge safety supports, speeding up installation and removal. Further, with the rapid clamp and release so enabled, roof edge safety supports designed in accord with the teachings of the present invention can be moved both easily and quickly as required or desired by work being performed on the roof. Noteworthy here is that many of the embodiments only require adjustment of a single driving hex or the like, while thereby activating a three-point securement with a parapet or other suitable structure.

Another benefit of roof edge safety supports designed in accord with the teachings of the present invention is that most are self contained, and can be deployed without the need to nail, screw, pin, or provide other fasteners to couple the edge support to the parapet, and thus do not require extra components be brought to fasten the edge support. This means there is less damage to the building surfaces and waterproofing, and also less cleanup of sharp objects. Nevertheless, instead of being attached to an edge clamp, where required and without the need for other or additional equipment a roof edge safety standard designed in accord with the teachings of the present invention can be inverted and anchored directly into the building structure such as shown and described with reference to FIG. 8.

While the foregoing details what is felt to be the preferred embodiment of the invention, no material limitations to the scope of the claimed invention are intended. For exemplary and non-limiting purpose, while the present invention is described for primary application to commercial roofs having parapets, those skilled in the art of roof edge safety upon reading the present disclosure will further understand and appreciate that the present invention may have similar applicability to other places besides commercial roofs, particularly those that have a significant drop or edge. As can be appreciated, the variants that would be possible from a reading of the present disclosure are too many in number for individual listings herein, though they are understood to be included in the present invention. Further, features and design alternatives that would be obvious to one of ordinary skill in the art are considered to be incorporated herein. The scope of the invention is set forth and particularly described in the claims herein below.

We claim:

1. In combination, a building and a roof edge safety system, said building comprising:

at least one elevational wall;

at least one roof adjoining said at least one elevational wall; and a parapet adjoining with and elevated with respect to said at least one roof and said at least one elevational wall, said parapet having at least two separate parapet elevational surfaces rising above said roof and meeting at a parapet top;

said roof edge safety system comprising:

at least one roof edge safety support having an edge clamp spanning said parapet top and applying a clamping force to said at least two separate parapet elevational surfaces, said edge clamp comprising a first contact pressing along a first force vector against a first one of said at least two separate parapet elevational surfaces, and a second contact and a third contact each pressing against a second one of said at least two separate parapet elevational surfaces along and thereby defining a second force vector, said second force vector equal in magnitude and opposed in direction to said first force vector, a clamp driver generating said clamping force, and a standard coupled adjacent to a first terminus to and rising from said edge clamp and extending therefrom to a top elevation above said parapet top and having at least one rope guide; and a tensioned cable passing through said at least one rope guide;

wherein said edge clamp further comprises a bifurcated clamp leg supporting said second contact and said third contact;

wherein said second contact and said third contact each define a contact surface that is coplanar with the other within a bifurcated contact plane, and wherein a line originating within said bifurcated contact plane equidistant between said second and third contacts and terminating with said contact surface of said first contact defines a clamping force axis;

wherein said clamp driver comprises a threaded rod extending longitudinally parallel to said clamping force axis;

wherein said clamp driver further comprises a driver head on a first end of said threaded rod that is configured to couple with a driver and rotate said threaded rod; and wherein said clamp driver further comprises a driver head on a second end of said threaded rod distal to said first end that is configured to couple with a driver and rotate said threaded rod.

2. In combination, a building and a roof edge safety system, said building comprising:

at least one elevational wall;

at least one roof adjoining said at least one elevational wall; and a parapet adjoining with and elevated with respect to said at least one roof and said at least one elevational wall, said parapet having at least two separate parapet elevational surfaces rising above said roof and meeting at a parapet top;

said roof edge safety system comprising:

at least one roof edge safety support having an edge clamp spanning said parapet top and applying a clamping force to said at least two separate parapet elevational surfaces, said edge clamp comprising a first contact pressing along a first force vector against a first one of said at least two separate parapet elevational surfaces, and a second contact and a third contact each pressing against a second one of said at least two separate parapet elevational surfaces along and thereby defining a second force vector, said second force vector equal in magnitude and opposed in direction to said first force vector, a clamp driver generating said clamping force, and a standard coupled adjacent to a first terminus to and rising from said edge clamp and extending therefrom to a top elevation above said parapet top and having at least one rope guide; and a tensioned cable passing through said at least one rope guide;

wherein said edge clamp further comprises a bifurcated clamp leg supporting said second contact and said third contact;

wherein said second contact and said third contact each define a contact surface that is coplanar with the other within a bifurcated contact plane, and wherein a line originating within said bifurcated contact plane equidistant between said second and third contacts and terminating with said contact surface of said first contact defines a clamping force axis; and wherein said standard is pivotal about a standard pivot axis that is transverse to clamping force axis, and said standard extends elevationally below said standard pivot axis, and wherein said clamp driver further comprises a force applied to said standard above said standard pivot axis.

3. The combination building and roof edge safety system of claim 2, wherein said standard further defines an "L" geometry.

4. In combination, a building and a roof edge safety system, said building comprising:

at least one elevational wall;

at least one roof adjoining said at least one elevational wall; and a parapet adjoining with and elevated with respect to said at least one roof and said at least one elevational wall, said parapet having at least two separate parapet elevational surfaces rising above said roof and meeting at a parapet top;

said roof edge safety system comprising:

at least one roof edge safety support having an edge clamp spanning said parapet top and applying a clamping force to said at least two separate parapet elevational surfaces, said edge clamp comprising a first contact pressing along a first force vector against a first one of said at least two separate parapet elevational surfaces, and a second contact and a third contact each pressing against a second one of said at least two separate parapet elevational surfaces along and thereby defining a second force vector, said second force vector equal in magnitude and opposed in direction to said first force vector, a clamp driver generating said clamping force, and a standard coupled adjacent to a first terminus to and rising from said edge clamp and extending therefrom to a top elevation above said parapet top and having at least one rope guide; and a tensioned cable passing through said at least one rope guide;

wherein said edge clamp further comprises a bifurcated clamp leg supporting said second contact and said third contact; and wherein said second contact and said third contact each define a contact surface that is perpendicular with the other.

5. In combination, a building and a roof edge safety system, said building comprising:

at least one elevational wall;

at least one roof adjoining said at least one elevational wall; and a parapet adjoining with and elevated with respect to said at least one roof and said at least one elevational wall, said parapet having at least two separate parapet elevational surfaces rising above said roof and meeting at a parapet top;

said roof edge safety system comprising:

at least one roof edge safety support having an edge clamp spanning said parapet top and applying a clamping force to said at least two separate parapet elevational surfaces, said edge clamp comprising a first contact pressing along a first force vector against a first one of said at least two separate parapet elevational surfaces, and a second contact and a third contact each pressing against a second one of said at least two separate parapet elevational surfaces along and thereby defining a second force vector, said second force vector equal in magnitude and opposed in direction to said first force vector, a clamp driver generating said clamping force, and a standard coupled adjacent to a first terminus to and rising from said edge clamp and extending therefrom to a top elevation above said parapet top and having at least one rope guide; and a tensioned cable passing through said at least one rope guide;

wherein said edge clamp further comprises a bifurcated clamp leg supporting said second contact and said third contact; and wherein said first contact comprises a horizontal plane cross-section that defines an arc.

6. In combination, a building and a roof edge safety system, said building comprising:

at least one elevational wall;

at least one roof adjoining said at least one elevational wall; and a parapet adjoining with and elevated with respect to said at least one roof and said at least one elevational wall, said parapet having at least two separate parapet elevational surfaces rising above said roof and meeting at a parapet top;

said roof edge safety system comprising:

at least one roof edge safety support having an edge clamp spanning said parapet top and applying a clamping force to said at least two separate parapet elevational surfaces, said edge clamp comprising a first contact pressing along a first force vector against a first one of said at least two separate parapet elevational surfaces, and a second contact and a third contact each pressing against a second one of said at least two separate parapet elevational surfaces along and thereby defining a second force vector, said second force vector equal in magnitude and opposed in direction to said first force vector, a clamp driver generating said clamping force, and a standard coupled adjacent to a first terminus to and rising from said edge clamp and extending therefrom to a top elevation above said parapet top and having at least one rope guide; and a tensioned cable passing through said at least one rope guide;

wherein said at least one rope guide further comprises a cable roller pivotal about a cable roller pivotal axis generally parallel to a longitudinal axis of said standard.

7. The combination building and roof edge safety system of claim 6, wherein a removable cable roller pin defines said cable roller pivotal axis, said cable roller in a first rope guide configuration having said cable roller pin passing through said cable roller and secured with said at least one rope guide, said cable roller in a second detached configuration separated from said cable roller pin and said at least one rope guide, wherein a cable may be passed unobstructed into said at least one rope guide, and said cable roller switched from said second detached configuration to said first rope guide configuration capturing said cable between said cable roller and said standard.

8. The combination building and roof edge safety system of claim 7, wherein said at least one rope guide further comprises a second removable cable retaining safety pin that in said first rope guide configuration passes through said at least one rope guide relatively more distal to said standard than said cable roller pin.

9. In combination, a building and a roof edge safety system, said building comprising:

at least one elevational wall;

at least one roof adjoining said at least one elevational wall; and a parapet adjoining with and elevated with respect to said at least one roof and said at least one elevational wall, said parapet having at least two separate parapet elevational surfaces rising above said roof and meeting at a parapet top;

said roof edge safety system comprising:

at least one roof edge safety support having an edge clamp spanning said parapet top and applying a clamping force to said at least two separate parapet elevational surfaces, said edge clamp comprising a first contact pressing along a first force vector against a first one of said at least two separate parapet elevational surfaces, and a second contact and a third contact each pressing against a second one of said at least two separate parapet elevational surfaces along and thereby defining a second force vector, said second force vector equal in magnitude and opposed in direction to said first force vector, a clamp driver generating said clamping force, and a standard coupled adjacent to a first terminus to and rising from said edge clamp and extending therefrom to a top elevation above said parapet top and having at least one rope guide; and a tensioned cable passing through said at least one rope guide;

wherein said roof edge safety system further comprises a second roof edge safety support spaced apart from and rigidly coupled to said at least one roof edge safety support by a support arm;

wherein said at least one roof edge safety support edge clamp further comprises a bifurcated clamp leg supporting said second contact and said third contact, wherein said second contact and said third contact each define a contact surface that is coplanar with the other within a bifurcated contact plane, and said bifurcated contact plane is parallel to and offset from a plane defined by a contact surface of said first contact, and wherein a line originating within said bifurcated contact plane equidistant between said second and third contacts and terminating with said contact surface of said first contact defines a clamping force axis, wherein said second roof edge safety support edge clamp further comprises a second roof edge safety support bifurcated clamp leg supporting a second roof edge safety support second contact and a second roof edge safety support third contact, and wherein said second roof edge safety support second contact and said second roof edge safety support third contact each define a contact surface that is perpendicular with the other.

* * * * *